United States Patent [19]

Williams

[11] Patent Number: 4,998,485

[45] Date of Patent: Mar. 12, 1991

[54] METHOD OF DISPOSING OF AND APPARATUS FOR GRINDING MOISTURE BEARING WASTE MATERIAL AND USING HEAT FROM BURNING WASTE MATERIAL TO REDUCE MOISTURE CONTENT THEREOF

[76] Inventor: Robert M. Williams, 16 La Hacienda, Ladue, Mo. 63124

[21] Appl. No.: 561,348

[22] Filed: Aug. 1, 1990

[51] Int. Cl.[5] ..... F23B 7/00

[52] U.S. Cl. ..... 110/234; 110/225; 110/232; 110/346

[58] Field of Search ..... 110/234, 232, 346, 225, 110/228

[56] References Cited

U.S. PATENT DOCUMENTS

| | | | |
|---|---|---|---|
| 4,236,886 | 12/1980 | Ansen et al. | 110/232 X |
| 4,489,664 | 12/1984 | Williams | 110/232 X |
| 4,750,436 | 6/1988 | Maury et al. | 110/232 X |

FOREIGN PATENT DOCUMENTS

| | | | |
|---|---|---|---|
| 0021714 | 2/1982 | Japan | 110/232 |
| 0850991 | 7/1981 | U.S.S.R. | 110/232 |

*Primary Examiner*—Edward G. Favors

*Attorney, Agent, or Firm*—Gravely, Lieder & Woodruff

[57] ABSTRACT

An apparatus arrangement in a system for circulating an inert fluid medium in a substantially closed and inert atmosphere during the grinding of wet gob to prevent spontaneous combustion and the initiation of fire from sparks created during grinding of moisture bearing waste material. The apparatus combines with a grinding mill a fluid circulating circuit with the grinding mill to separate ground particulate gob from the circulating fluid medium, and a second fluid circulating circuit in association with a boiler to burn the ground gob material for creating an oxygen deficient atmosphere in the fluid circulating circuit.

6 Claims, 2 Drawing Sheets

METHOD OF DISPOSING OF AND APPARATUS FOR GRINDING MOISTURE BEARING WASTE MATERIAL AND USING HEAT FROM BURNING WASTE MATERIAL TO REDUCE MOISTURE CONTENT THEREOFcl BACKGROUND OF THE INVENTION

1. Field of the Invention

This invention is directed to a method of reducing the moisture content level in waste material by utilizing the combustion gases produced by the combustion of waste material to reduce the moisture content during the preparation of the moisture bearing material for grinding, and to provide an inert atmosphere during the drying and grinding process.

2. Description of the Prior Art

The problem in connection with prior attempts to burn moisture bearing material is that the wetness or moisture content of such material needs to be greatly reduced so it will be amenable to grinding to a size that will be suitable for feeding to a circulating fluid bed combustor (CFB). One class of waste material called gob usually has a moisture content in the order of about fifteen percent, and is a mixture of coal containing clay, slate and other particulate. That mixture when it contains up to fifteen percent free moisture will plug mills used to grind the solids. However, when the gob material is freed of moisture down to a state of about six percent moisture it can be ground to be used in a furnace. Another class of waste material called sludge usually has a moisture content of sixty to seventy percent and usually is a mixture of paper and wood with moisture up to 70 percent will plug a mill when attempting to grind the solids.

SUMMARY OF THE INVENTION

It has been discovered that moisture bearing waste material, if substantially dried and reduced in particle size, can be used as the fuel to generate the necessary heat to effectively pre-dry the waste material so that the grinding of the waste material can be successfully carried on without plugging the mill which is used to grind the waste material. It has also been found that the grinding of the waste material needs to be carried on in an inert or low oxygen content atmosphere so that if sparks are struck from hard particulate during the grinding process internal combustion at the grinding mill will not start.

The important object of the invention is to provide an inert circulating system between a circulating fluid bed combustion boiler and a grinding mill so that the heat generated by combustion of waste material can be applied to the grinding mill to effect the moisture drying of the waste material so the mill will not plug and there will be no necessity to release the heat energy externally of the system.

The objects of the invention are to employ combustion heat energy to dry and render the moisture bearing material inert to spontaneous combustion and capable of being ground, and to borrow the hot gases from combustion of the resulting ground material for drying and inerting the grinding loop before feeding the ground material to the CFB Boiler.

It is an object of the invention to use hot gases from a circulating fluid bed combustion so the heat energy can dry the material and return the evaporated moisture to the CFB Boiler, whereby no external heat source is needed after the system has attained operating temperature.

A further object is to operate waste material grinding apparatus so the moisture brought into the grinding apparatus is evaporated so the vapor can be transferred to a CFB Boiler and oxygen deficient hot gas returned to the grinding apparatus to promote evaporation of the entering moisture, whereby heat energy is recirculated so no external energy needs to be brought in from outside and no energy is lost to the outside.

BRIEF DESCRIPTION OF THE DRAWING

The invention is disclosed in schematic views to illustrate certain arrangements of items of apparatus, wherein.

DETAILED DESCRIPTION OF THE INVENTION

The burning of either class of moisture bearing waste material, which is usually wet and sticky, has presented a problem in effecting its ability to be burned. The problem is that the material needs to be ground to a size suitable for burning, and the moisture content needs to be vaporized as it is too great for proper combustion. The present invention seeks to process the material for its combustion to ash and to utilize the heat of combustion to supply the energy to dry the incoming material.

Figure 1:
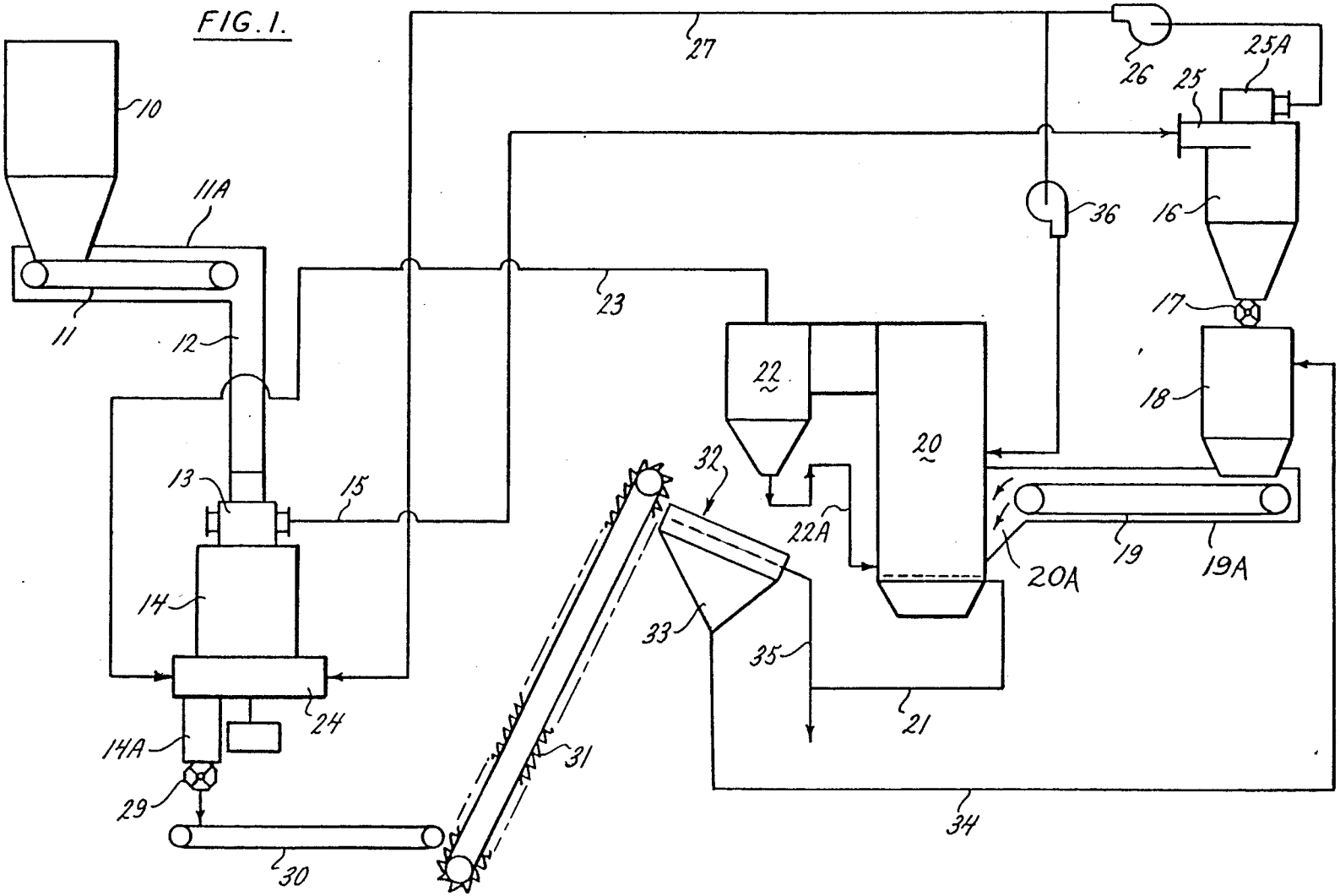
FIG. 1 is a schematic view of apparatus for handling the gob class of moisture bearing waste material.

In FIG. 1 the incoming material is collected in a bin 10, and is moved to feeder conveyor 11 in an enclosure 11A that delivers it to an enclosed conduit 12 connected to the inlet fitting 13 of a roller mill 14. The mill delivers the finely ground material to a conduit 15 for delivery to a cyclone separator 16. At the cyclone 16 the fines are collected and pass through a gate 17 and are collected in a bin 18 for subsequent delivery by belt conveyor 19 directed through an enclosure 19A to the inlet 20A at the circulating CFB 20.

The combustion that occurs in the boiler 20 produces ash which is released to the outlet conduit 21, while the moist air and hot gases are moved to a cyclone 22 to extract the fines from the hot gaseous vapor which flow back from the CFB Boiler to enter the inlet bustle 24 at the mill 14. The fines separated from the hot gases in cyclone 22 are returned in a loop seal 22A to the CFB Boiler.

The gases, ground material and hot vapors which are discharged from the mill 14 into conduit 15 are received at the inlet 25 of cyclone 16 and the ground material is separated while the gases are recovered at the outlet 25A of the cyclone 16 through the operation of the blower 26 in the return conduit 27 connected into the bustle at the mill 14. Any hard to grind solids are released from the mill 14 at the discharge 14A at a rotary gate 29 associated with a conveyor 30 to collect the hard to grind content of the material and deliver it to a bucket conveyor or other conveying means 31. The material from the conveyor 31 is again beneficiated by being deposited on a vibrating screen device 32 which separates any burnable fine material from the nonburnable hard material. The fine material falls into the collector 33 for conveyance by conduit 34 to the bin 18, while the hard material is released to conduit 35 to join with the ash moved in conduit 21 from the CFB boiler 20. This hard to grind material has first been beneficiated in the roller mill and now no longer contains any valuable BTU material.

In FIG. 1 it is apparent that there is a first circulating loop created by the blower 26 which draws the fine material and gaseous vapors from the roller mill 14 to the cyclone 16 and returns the gases by conduit 27 to the roller mill bustle 24.

A second circulation loop is created by a blower 36 which circulates a proportion of the gases from conduit 27 and force it through the CFB Boiler 20 where the gasses are heated to the order of substantially 1600 degrees F. The heated gases or vapor are recovered from the CFB cyclone 22 by conduit 23 and move to the roller mill to dry the waste material in the roller mill 14.

In the system depicted in FIG. 1, the waste material from the bin 10 is ground in the roller mill in a hot gas atmosphere (after the start up using external fuel) received from the CFB Boiler 20 outlet 23 at about 1600° F. which renders it inert due to the oxygen content being reduced to the level of 6 to 8%, and the moisture content of the material to reduce to 6% or less. With the inert gas moving in the first loop there is no problem with spontaneous combustion from the grinding action in the mill 14. The only way moisture can enter the system is by the moisture brought in by the material. It is evaporated and the moisture is conveyed to the cyclone 16 and then exhausted from the mill circuit to the combuster circuit by fan 36.

Figure 2:
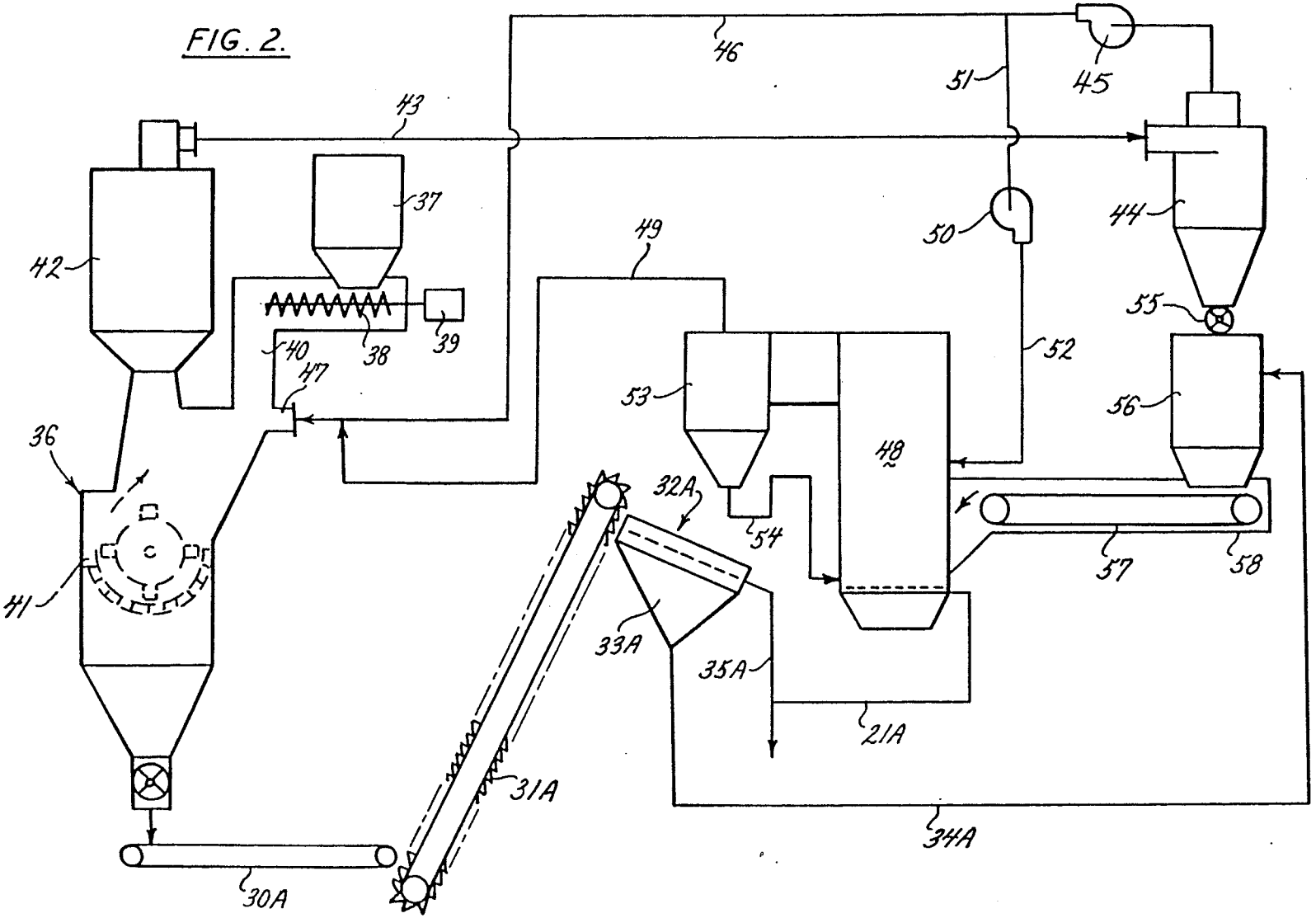
FIG. 2 is a schematic view of another type of apparatus for handling other character of waste material.

Turning now to FIG. 2, the system employs an impact mill 36, having a waste material supply bin 37 for collecting a volume of waste material that is moved by an auger 38 having a drive motor 39. The waste material is moved into the feed chute 40 that opens into the impact rotor chamber which provides a bottom chamber for collecting hard to grind material. The mill 36 throws the ground material upwardly to a separator unit 42 for allowing fine particulate to be conducted by a conduit 43 to a cyclone 44 where the solids are separated from the gaseous fluid that transported the material to the cyclone 44. The oversize material in the separator 42 is returned to the mill for further reduction.

The mill 36 and cyclone 44 are in a first circulating loop whereby the waste material is reduced by the mill 36 and transported by conduit 43 to the cyclone 44 by gaseous fluid which is returned to the mill 36 by a blower 45 by way of return conduit 46 to the gaseous fluid inlet 47 at the mill 36.

The system is provided with a circulating fluid bed boiler 48 to produce hot gaseous fluid for pre-drying the incoming waste material. That hot gaseous fluid is raised to a temperature of the order of about 1600 F and is conducted by conduit 49 to the mill inlet 47. The boiler 48 is in a second loop which is made up of a blower 50 with its suction inlet 51 connected into the conduit 46 so that some of the gaseous fluid is borrowed from conduit 46 and is delivered by conduit 52 to the boiler 48 where it is heated and flows to a cyclone separator 53 to remove any fines that are picked up in the boiler 48 and returned by a sealed loop 54 to the combustion zone in the boiler. Thus the second loop delivers the hot gaseous fluid to the mill 36 to establish a pre-drying event in the mill to prevent plugging and to produce an inert atmosphere in the mill.

The source of fuel for the boiler in either system of FIGS. 1 and 2 is generated by the cyclone 16 or 44 which gathers the ground particulate material and passes it through a rotary gate 17 or 55 to a bin 18 or 56. The bin 18 or 56 has its outlet provided with a belt conveyer 19 or 57 in a closed housing 19A or 58 so that no outside air can enter the system which must be oxygen deficient to make the system inert.

The systems operate without loss of energy due to the recirculation of the heat from CFB Boiler 20 or 48 heat to the respective mills which dries and prepares the waste material to be ground to a fineness of the order of particles having an average size of 50 percent passing 700 microns. The only external air entering either system occurs at the bin 10 or 42 where the waste particles are supplied to the closed conveyor 11 or auger 38. The oxygen is consumed by the boiler so the exhaust is oxygen deficient and therefore inert.

What is claimed is:

1. In apparatus for disposing of waste material in an inert circulating system, the combination comprising:

(a) a grinding mill having inlet means for receiving waste material and a circulating medium inlet and an outlet for ground particulate waste material with said circulating medium;

(b) a boiler having inlet means for receiving ground particulate waste material and circulating fluid medium, and an outlet for hot inert circulating fluid medium;

(c) first circuit means containing means to receive from said grinding mill outlet the ground particulate waste material together with circulating medium and means to effect separation of said ground particulate waste material from said circulating medium, and having an outlet from said means to effect said separation for the circulating medium connected to said grinding mill circulating medium inlet means;

(d) other circuit means containing said boiler, and having an outlet connected to said grinding mill circulating medium inlet means, said other circuit means having a connection to said first circuit means which extends to said boiler inlet means;

(e) feed means connected from said means to effect separation of said ground particulate waste material to said boiler inlet means to supply dried and ground particulate waste material to said boiler to facilitate combustion in said boiler;

(f) means to supply moist waste material to said grinding mill inlet means which introduces moisture to the system; and (g) blower means in each of said first and other circuit means for moving hot inert circulating medium from said boiler to said grinding mill to effect drying of said moist waste material and to withdraw circulating medium from said first circuit means to said boiler to maintain the inert condition of said hot inert circulating fluid medium and to move the evaporated moisture back to the boiler thereby assuring no energy loss.

2. In apparatus as set forth in claim 1 the further combination wherein said means to effect separation of said ground particulate waste material from said circulating medium is a cyclone separator.

3. In apparatus as set forth in claim 1 the further combination of means to release hard to grind material from said grinding mill, and means to beneficiate said released hard to grind material, whereby to separate burnable fraction for intermingling with material moved by said feed means.

4. In apparatus as set forth in claim 1 the further combination of separator means at said boiler outlet for separating fine particulate material in said hot inert medium, and means to return the separated fine particulate material to said boiler.

5. Apparatus for simultaneously applying drying heat to waste material and grinding waste material for use as the fuel to produce drying heat, the apparatus comprising:

(a) Mill means to grind waste material to a size suitable for burning to produce heat;

(b) boiler means adapted to burn waste material as a fuel for producing heat;

(c) fluid conducting circuit means operably interrelating said boiler means and said grinding means to supply the heat produced by burning of waste material in said boiler means for reducing the moisture in the waste material of said grinding means; and (d) other fluid conducting circuit means interconnecting said fluid conducting circuit means and said boiler means for directing a portion of the fluid from said fluid conducting circuit means to render the fluid in said fluid conducting circuit supplied to said grinding means substantially inert.

6. A method of conditioning a supply of a waste material having a moisture content by reducing the size of the waste material and evaporation of the moisture, the method comprising the steps of:

a. providing a grinding device, a separator device and a boiler device;

b. establishing a gas conducting connection from the boiler device to the grinding device;

c. establishing a ground waste material and gas conducting connection with the separator device;

d. establishing a conducting connection between the separating device and the grinding device for the return of the gas to the grinding device;

e. establishing a conducting connection between the separating device and the boiler device to supply reduced waste material to the boiler device; and f. utilizing the heat generated in the boiler device to raise the temperature of the gas in the gas connection to the grinding device to a level for vaporizing the moisture content in the supply of the waste material.

* * * * *